US005269984A

United States Patent [19]

Ono et al.

[11] Patent Number: 5,269,984

[45] Date of Patent: Dec. 14, 1993

[54] PROCESS OF MAKING GRAPHITE FIBER

[75] Inventors: Keizo Ono; Kenji Mitsuyasu, both of Iyo; Mototada Hukuhara, Kawasaki, all of Japan

[73] Assignee: Toray Industries, Inc., Japan

[21] Appl. No.: 930,196

[22] Filed: Aug. 14, 1992

Related U.S. Application Data

[60] Division of Ser. No. 711,580, May 31, 1991, abandoned, which is a continuation of Ser. No. 156,709, Feb. 17, 1988, abandoned.

[30] Foreign Application Priority Data

Feb. 20, 1987 [JP] Japan ..... 62-35743

[51] Int. Cl.[5] ..... D01F 9/22

[52] U.S. Cl. ..... 264/29.2; 264/29.6; 264/29.7; 264/182; 423/447.6; 423/447.7; 423/447.8; 423/448

[58] Field of Search ..... 264/29.2, 29.6, 29.7, 264/182, 210.8; 423/447.4, 447.6, 447.7, 447.8, 448

[56] References Cited

U.S. PATENT DOCUMENTS 3,412,062 11/1968 Johnson et al. ..... 264/DIG. 19
3,993,719 11/1976 Matsumura et al. ..... 264/29.1
4,695,415 9/1987 Setsuie et al. ..... 264/29.2
4,869,856 9/1989 Takahashi et al. ..... 264/29.2
4,917,836 4/1990 Yamane et al. ..... 264/29.2

FOREIGN PATENT DOCUMENTS 44-21175 9/1969 Japan .
59-118203 7/1984 Japan .

*Primary Examiner*—Leo B. Tentoni
*Attorney, Agent, or Firm*—Austin R. Miller

[57] ABSTRACT

A graphite fiber having an elastic modulus E of 340–680 GPa, a microvoid radius of not larger than 20 Å and a crystal size $L_c$ (Å) satisfying the following formula:

$$L_c^3 \leqq 0.918 \times 10^3 E - 3 \times 10^5$$

is valuable for a composite material having an improved compression strength. The graphite fiber is made preferably by oxidizing an acrylonitrile polymer precursor containing 0.05–8 wt. % of comonomer units and having an iodine adsorption amount of not larger than 3 wt. % and an orientation degree of at least 85%, at 200°–300° C. in an oxidative atmosphere under tension to obtain an oxidized fiber having a water adsorption of not larger than 7 wt. % and an orientation degree of at least 78%, followed by carbonization and graphitization of the oxidized fiber under tension.

10 Claims, 3 Drawing Sheets

PROCESS OF MAKING GRAPHITE FIBER

This application is a divisional of application Ser. No. 07/711,580, filed May 31, 1991, now abandoned, which is a continuation of U.S. Ser. No. 07/156,709 filed Feb. 17, 1988, now abandoned.

BACKGROUND OF THE INVENTION (1) Field of the Invention

The present invention relates to a graphite fiber. More particularly, it relates to a graphite fiber, which is valuable for a composite material having a plastic as a matrix and having a high compression strength.

(2) Description of the Related Art

Since carbon fibers have a specific strength or specific elastic modulus higher than that of metallic materials, composite materials composed of a carbon fiber and a plastic matrix are now widely used in golf shafts, fishing rods and the like in the fields of sports and leisure and as light-weight structural materials mainly for aircraft, spaceship and communication satellite. With the increased demand for these composite materials, a further improvement of the quality is desired, and great advances have been made in the improvement of the tensile strength. However, the compression strength has not been similarly improved, and a problem of an unbalance between the compression strength and tensile strength has arisen.

In graphite fibers having an especially high elastic modulus, a reduction of the weight is generally realized by effectively utilizing the rigidity to reduce the thickness of a structural material. However, in this case, the attainment of the intended weight-reducing effect is restricted by the resulting poor compression strength.

As is well-known, a carbon fiber is obtained by calcining an organic fiber of cellulose, polyacrylonitrile or pitch at a high temperature in an inert gas. In general, the final calcination temperature is higher than 1,000° C., and especially in the case of a graphite fiber, the final calcination temperature sometimes exceeds 2,000° C.

Where polyacrylonitrile is used as the starting material, it is widely known that, to obtain a carbon fiber having a high strength and high elastic modulus, it is an important requirement that, at the step of preparing the starting fiber, a high draw ratio be adopted to produce a highly oriented structure and the highly oriented fiber be calcined under tension. Carbon can take two crystal structures, i.e., a diamond structure and a graphite structure. In general, the carbon fiber has a graphite structure comprising a laminated net planes. This graphite structure has a much higher anisotropy than an ordinary crystal structure of a metal, and the mechanical characteristics in the direction of the fiber axis are enhanced by orienting the net planes selectively in the direction of the fiber axis.

To realize a high tensile strength, an enhancement of the completeness of the crystal structure as mentioned above, and a prevention of bonding among filaments, and a removal of surface defects such as foreign substances, impurities and mechanical damage are important, and many techniques for improving the strength based on this understanding have been proposed.

There have been little investigations into or proposals for an improvement of the compression strength in carbon fiber-reinforced composite materials. Only Japanese Unexamined Patent Publication No. 59-118,203 teaches that, if the single fiber thickness is increased, the compression strength of the composite material is improved. Indeed, it is considered that, in a fiber-reinforced composite material, the size of the constituent fiber probably has an influence on the compression strength. However, in the case of a brittle material such as a carbon fiber, an increase of the fiber diameter results in an increase of the probability of an inclusion of defects, and an attainment of a high strength becomes difficult. Furthermore, since carbonization of a carbon fiber is carried out by a thermal decomposition reaction in the solid phase, a long reaction time is needed for a uniform graphitization in the case of a carbon fiber having a large diameter. Accordingly, the process becomes economically disadvantageous.

Therefore, the development of a matrix having a higher rigidity attracted more attention than the search for a solution in the carbon fiber per se. In other words, few trials have been made into improvements of the compression strength of a carbon fiber-reinforced composite material by improving the carbon fiber.

The object of the present invention is to provide a carbon fiber valuable as a composite material having a high compression strength by rationalizing the inner structure of the carbon fiber, contrary to the conventional technique. The objective fiber of the present invention is a graphite fiber having an elastic modulus of at least 340 GPa. This is because in the case of, for example, a polyacrylonitrile carbon fiber, as the elastic modulus is increased, the compression strength of the composite material is drastically reduced. Furthermore, as pointed out hereinbefore, although it is considered that the characteristics of a carbon fiber having a high elastic modulus will enable practical use thereof as a thin structural material, expansion of this use is often obstructed by the poor compression strength.

SUMMARY OF THE INVENTION

Therefore, a primary object of the present invention is to provide a graphite fiber which is valuable for a composite material having an improved compression strength and an expanded degree of freedom of design.

In accordance with the present invention, there is provided a graphite fiber having an elastic modulus E of 340 to 680 GPa wherein the crystal size $L_c$ (Å) determined from the half value width of the diffraction to the (002) plane of carbon network by the wide-angle X-ray diffraction satisfies the requirement represented by the following formula (I) relative to the elastic modulus E (GPa) of the fiber:

$$L_c^3 \leqq 0.918 \times 10^3 E - 3 \times 10^5 \quad \text{(I)}$$

and the microvoid radius determined from the small-angle X-ray scattering defined in the text of the specification is not larger than 20 Å.

Figure 1:
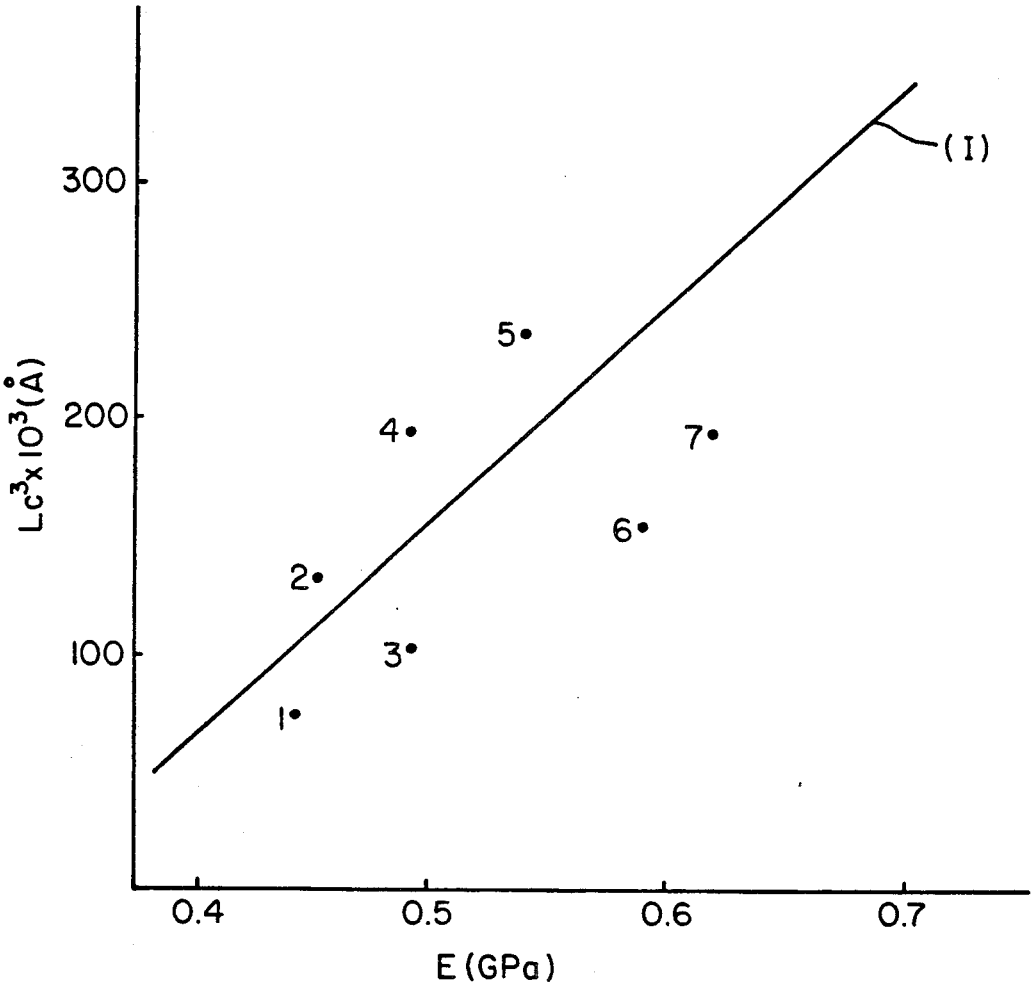
FIGS. 1 and 2 illustrate the relationships between the crystal size $L_c$ (Å) and the elastic modulus E (GPa) in graphite fibers obtained in Examples 1 and 2, respectively, in which the line (I) is the boundary line of the formula (I), that is, $L_c^3 = 0.918 \times 10^3 E - 3 \times 10^5$, and affix numbers corresponding to graphite fiber numbers in Tables 2 and 4.

obtained in Examples 1 through 4, in which the line (II) is the boundary line of the formula (II), that is $\sigma c = 1.715 - 1.5 \times 10^{-3} E$.

DESCRIPTION OF THE PREFERRED EMBODIMENTS

The crystal of a carbon has a structure comprising laminated carbon network and a very high anisotropy. Accordingly, it is easily understood that the crystal is very strong against a tensile force but very weak against shear buckling. An increase of this anisotropy is most effective for a manifestation of the elastic modulus, but it is obvious that in view of the object of the present invention, development of the anisotropy is not preferred. Accordingly, it is necessary to manifest the elasticity while controlling the anisotropy. As pointed out hereinafter, it is necessary to form a dense structure by reducing the crystal size as much as possible relative to the elastic modulus, while controlling the formation of microvoids.

The crystal size and microvoid radius referred to in the present invention are determined according to the following methods.

(1) Crystal Size $L_c$

The crystal size is calculated from the half value width in the diffraction peak in the vicinity of $2\theta = 26°$ corresponding to the plane index (002) of carbon network by the wide-angle X-ray diffractometry according to customary procedures by using the following formula:

$$L_c = \lambda / \beta_O \cos\theta \quad \text{(a)}$$

wherein $\lambda$ stands for the wavelength (Å) of the X-ray (CuK$\alpha$ is used and $\lambda$ is 1.5418 Å), $\beta_O$ is defined by the formula of $\beta_O^2 = \beta_E^2 - \beta_1^2$ (in which $\beta_E$ stands for the measured apparent half value width and $\beta_1$ is an apparatus constant, which is $1.05 \times 10^{-2}$ rad), and $\theta$ stands for the Bragg diffraction angle.

(2) Microvoid Size

The microvoid size is determined from the small-angle X-ray scattering pattern according to the following procedures.

In the determination of the small-angle scattering, the sample is arranged in parallel so that scattering in the direction vertical to the fiber axis can be measured, is fixed by a colloidion solution, and is set so that the fiber axis is in parallel to the longitudinal direction of the X-ray slit.

An X-ray generator (Model RO-200 supplied by Rigaku Denki) and a CuK$\alpha$ ray monochromatized by a graphite monochrometer are used.

(a) To avoid the influence of incident X-ray beams from the obtained small-angle scattering pattern, the substantial scattering intensity within the range of the scattered light $2\theta = 0$ to 0.75° is approximated by assuming the following quinary function from the scattering intensity of $2\theta = 0.75$ to 1.25°:

$$I(h) = \Sigma a_i h^i \quad \text{(b)}$$

wherein h is expressed by $h = (4\pi/\lambda) \sin\theta$, and $a_i$ ($i = 0 \ldots 5$) is the constant of each degree determined from the scattering intensity in the range of $2\theta = 0.75$ to 1.25°, by the method of least squares.

(b) To eliminate the background included in the scattering pattern, by using the scattering intensity of the scattering angle $2\theta = 5.5$ to 6.0, $I(h) \cdot h^3$ is plotted to $h^3$ from h defined above. The obtained results are regarded as a straight line, the gradient of the straight line is determined by the method of least squares, and the obtained value is designated as the background scattering intensity.

The scattering pattern is determined by subtracting the background from I(h).

(c) Then, correction of the slit is made according to the method of M. Deutsch and M. Luban [see, if necessary, J. Appl. Cryst., Vol. 11, p. 87, ('78)]. The shape of the incident X-ray is assumed to be as rectangular.

(d) The scattering intensity I(h) obtained after the above-mentioned corrections (a) through (c) is subjected to Fourier transformation based on the following formula:

$$P(r) = \frac{1}{2\pi^2} \int_0^{h_{max}} I(h) \cdot (hr) \cdot \sin(hr) dh \quad \text{(c)}$$

wherein $h_{max}$ is the value of h corresponding to the scattering angle $2\theta = 5°$.

When the value of r giving the maximum value of the so-determined P(r) is $r_{max}$, assuming that the sectional shape of the void is circular, the diameter D of the section of the void is determined according to the following formula:

$$D = r_{max} / 0.525$$

The tensile strength, flexural strength, and compression strength of a composite reinforced with the graphite fiber of the present invention are determined according to the methods of ASTM 3039-76, ASTM 790-80, and ASTM 3410-75, respectively.

In accordance with one preferred embodiment of the present invention, there is provided a graphite fiber which satisfies not only the above-mentioned requirements but also the requirement of the so-determined compression strength $\sigma c$ (GPa) of the graphite fiber-reinforced composite, which is represented by the following formula (II), relative to the elastic modulus E (GPa):

$$\sigma c \geqq 1.715 - 1.5 \times 10^{-3} E \quad \text{(II)}$$

This graphite fiber-reinforced composite has a very high compression strength. Therefore, the thickness of the composite material can be remarkably reduced and the degree of freedom of design can be greatly increased in the composite material.

The preparation of the graphite fiber of the present invention will now be described with reference to an embodiment wherein polyacrylonitrile is used as the starting material.

As pointed out above, the first requirement of the present invention is that the crystal size must be reduced to a value lower than a specific value. As the result of investigation, it was found that the crystal size of graphite is most influenced by the maximum temperature of graphitization. More specifically, a product obtained at a low graphitization temperature has a small crystal size, and accordingly, the graphitization must be carried out at as low a temperature as possible. However, a desired elastic modulus should be obtained, and therefore, a precursor must have a structure which can easily be graphitized to have high elastic modulus even at a low graphitization temperature.

In this connection, selection of the amount of a comonomer to be copolymerized with acrylonitrile in the preparation of the starting polymer is important. Namely, as the amount of the comonomer is increased, the glass transition point is lowered and thermal relaxation easily occurs in the molecule chain, and the orientation structure of the starting fiber is disturbed, especially at the oxidation step, with the result that it becomes difficult to increase the elastic modulus. Therefore, the amount of the copolymer is controlled to a value lower than a certain value. If the comonomer is more bulky than the acrylonitrile, that is, the molecular weight of the comonomer is higher than that of acrylonitrile, this relaxation effect is high. Therefore, the weight ratio is more appropriate than the molar ratio for defining the amount of the comonomer. The amount of the comonomer units is in the range of 0.05 to 8% by weight, preferably 0.05 to 4% by weight, based on weight of the copolymer. If the amount of the comonomer is smaller than 0.05% by weight, it is difficult to obtain a precursor fiber having an iodine adsorption amount of not larger than 3% by weight.

Another important factor is the denseness of the precursor fiber. The graphite fiber of the present invention is characterized in that the fiber is highly dense, and to this end, preferably the starting fiber already has a dense structure.

The denseness of the precursor fiber can be evaluated based on the iodine adsorption amount described below.

Namely, 1 liter of an aqueous solution containing 50 g of iodine, 10 g of 2,4-dichlorophenol, 90 g of acetic acid and 100 g of potassium iodide is prepared. In 100 ml of the aqueous solution is immersed 0.5 g of a dry sample, and the adsorption treatment is carried out at 60±0.5° C. for 50 minutes. After the treatment, the sample is washed in running water for 30 minutes, and centrifugal dehydration is carried out. The dehydrated sample is dissolved by heating in 100 ml of dimethylsulfoxide, the iodine concentration is determined by the potentiometric titration using a 1/10N aqueous solution of silver nitrate, and the amount of iodine adsorbed in the dry sample is calculated.

The iodine adsorption amount corresponds to the quantity of microvoids present in the precursor fiber or the structurally coarse portion. Accordingly, to obtain a dense graphite fiber, preferably the precursor fiber per se is dense and the iodine absorption amount of the precursor fiber is small. To attain the object of the present invention, the iodine adsorption amount should be not larger than 3% by weight, preferably not larger than 2% by weight.

The iodine adsorption amount of the precursor fiber depends mainly on such fiber-forming conditions as spinning, coagulating and drawing, and the kind of oiling agent applied. More specifically, at the coagulation in the wet spinning process, the size of the spinneret orifice or the spinning speed is controlled so that the draft is as low as possible. For this purpose, a higher concentration of the spinning solution is preferred, and the dry jet wet spinning method in which an extruded fiber is travelled in the air and then in a coagulation bath is preferable to the wet spinning method. While the extruded fiber is travelled in the air in the flowable state before contact with the coagulant, attenuation is caused and the substantial draft is reduced, and therefore, a dense precursor fiber is easily obtained according to the dry jet wet spinning method. The substantial draft ratio is preferably 6 or less.

To obtain a dense precursor fiber, preferably the drawing is carried out in the wet state before drying while maintaining the draw ratio and temperature at levels as high as possible within the range where sticking does not occur among filaments. The draw ration is at least 10 times the original length. An oiling agent applied before drying is likely to diffuse and permeate into the interior of the fiber in the swollen state, to reduce the denseness. Accordingly, an oiling agent having a high molecular weight is selected. A silicone oiling agent having a high water repellency is especially preferred.

Conversion of the so-obtained dense acrylic fiber to a graphite fiber by calcination and graphitization is accomplished according to the conventional technique. Namely, the acrylic fiber is oxidized, a carbonization treatment is carried out at a temperature of 400° to 1,500° C. in an inert atmosphere, and a graphatization treatment is carried out at a higher temperature. In this process, the following conditions are adopted.

At the oxidizing treatment, the acrylic fiber is heated in an oxidative atmosphere containing at least 15% by volume of oxygen, preferably in air, maintained at 200° to 300° C., while being kept under tension at least in the first half stage of the oxidation treatment, to cause cyclization and oxidation of polyacrylonitrile, whereby the heat resistance is improved. Although the fiber is elongated under tension in the first half stage of the oxidation treatment, the fiber may be either elongated under tension or kept at a constant length in the second half stage thereof. It is known that cyclized and oxidized polyacrylonitrile shows a moisture-absorbing property caused by a chemical change of the structure, and the quantity of absorbed water is an indicator of the degree of oxidation. In the present invention, to obtain a dense graphite fiber, the degree of oxidation is controlled to a certain low level. Although Japanese Examined Patent Publication No. 44-21,175 teaches that preferably the oxidizing treatment is carried out so that oxygen permeates substantially completely into the interior of the precursor, as the result of investigation by the present inventors it was found that, if permeation of oxygen is excessive, the formation of microvoids at the subsequent carbonization step is conspicuous and the specific gravity is reduced, although the reason for this is not clear. Therefore, an excessive permeation of oxygen is not preferable.

The amount of water adsorbed in the oxidized fiber can be determined according to the following procedures. Namely, the oxidized fiber is allowed to stand at room temperature for about 16 hours in a desiccator, the lower portion of which is charged with an aqueous solid phase, and when the equilibrium adsorption is attained, the amount of water is calculated according to the weight method.

If the oxidizing treatment is carried out until a sufficient permeation of oxygen has occurred, this value of the amount of adsorbed water reaches ten and some %, but to attain the object of the present invention, preferably this value is not larger than 7% by weight. The lower limit of this value is not particularly critical, but if the value is too small, the yield of carbonization is reduced and the cost is increased. If the value is further reduced, yarn breakage occurs at the carbonization step and the production is hindered. Therefore, preferably the value is about 3 to about 4% or more.

Still another important requirement is that relaxation of the orientation should be controlled at the calcination step. A highly oriented fiber which has been drawn at a high draw ratio is generally used as the precursor fiber for a carbon fiber, but if this orientation is relaxed, the intended object cannot be attained. Since relaxation of the orientation is especially conspicuous at the initial stage of the oxidizing treatment, prevention of this relaxation is important. A polyacrylonitrile precursor fiber having an orientation degree of at least 85%, preferably at least 90%, as determined by the X-ray method, is used.

As well known, the graphite crystal of the obtained carbonized fiber is influenced by the orientation of the starting fiber, but the orientation degree of the graphite structure is important for the carbon fiber. In an oxidized fiber, if X-ray diffractometry is carried out, a diffraction pattern corresponding to the carbon network is already observed because of the cyclized chain structure of the nitrile group. To attain the object of the present invention, preferably, and irrespective of the orientation degree of the starting fiber, the orientation degree ($\pi$) of the oxidized fiber, determined from the intensity distribution of the diffraction patterns on the equatorial line obtained when X-rays are incident from the direction vertical to the fiber axis, according to the following formula is at least 78%, especially at least 80%:

$$\pi(\%) = \frac{180 - H}{180} \times 100$$

wherein H stands for the half value width (deg.) of the peak corresponding to the plane index (002) of the carbon network of the oxidized fiber in the intensity distribution measured along the Debye ring of the strong diffraction in equatorial line.

To attain the object of the present invention, i.e., the object of obtaining a graphite fiber suitable for the production of a composite having a high compression strength while controlling development of the crystal structure of graphite at a low temperature, the orientation degree of the oxidized fiber must be high.

As process factors having an influence on the value of the orientation degree of the oxidized fiber, there can be mentioned the temperature, tension and atmosphere adopted for the oxidizing treatment. If the temperature is high, the orientation of polyacrylonitrile is relaxed prior to cyclization and good results cannot be obtained. Preferably, the tension is maintained at as high a level as possible. If the oxygen concentration in the oxidizing treatment atmosphere is lower than 15%, an oxidizing fiber having a high orientation degree cannot be obtained.

Note, other requirements should be taken into consideration. For example, the orientation degree of the precursor fiber should be high and a precursor fiber having a fine single fiber denier, preferably one denier or less, should be used. As pointed out hereinbefore, the amount of the comonomer should be controlled to as low a level as possible.

The so-obtained oxidized fiber is carbonized and graphitized according to customary procedures. The carbonization is carried out at a temperature of 400° to 1,500° C., preferably 800° to 1,500° C. in an inert atmosphere. The graphitization is carried out at a highest temperature of 2,200° to 2,800° C. in an inert atmosphere. Note, the adoption of conditions relaxing the orientation should be avoided at the carbonizing and graphitizing steps. Namely, it is necessary to maintain the tension at as high a level as possible at each step, and if the above-mentioned oxidized fiber is used according to the present invention, a graphite fiber having a high elastic modulus can be obtained at a lower temperature than the temperatures adopted in the conventional techniques.

As apparent from the foregoing description, the graphite fiber of the present invention is structurally characterized by a small crystal size and a reduced number of microvoids. In a composite material comprising this graphite fiber and a plastic matrix, the compression strength is drastically increased, and compared with the conventional graphite fibers, the compression strength of the composite is greatly improved without a reduction of the elastic modulus. The mechanical characteristics are well-balanced, and the thickness and weight of the composite can be reduced.

The present invention will now be described in detail with reference to the following examples.

EXAMPLE 1

An acrylonitrile polymer comprising 99% by weight of acrylonitrile and 1% by weight of methacrylic acid was prepared by conducting the polymerization in a dimethylsulfoxide (hereinafter referred to as "DMSO") according to customary procedures to obtain a solution of a polymer having an [$\eta$] of 1.8 (the viscosity of the solution was 600 poise measured at 45° C.).

Using a spinneret having 3,000 orifices, each having a diameter of 0.2 mm, the solution was once extruded in the air and was introduced in a 30% aqueous solution of DMSO maintained at 15° C. to effect coagulation.

The coagulated fiber was washed with water and drawn in hot water, an oiling agent composed mainly of aminosiloxane was applied to the fiber, and the fiber was heat-treated under dry conditions whereby water was removed from the applied oiling agent and the fiber was densified. Then, the fiber was drawn in steam maintained at a pressure of 5.5 kg/cm$^2$·G. at a total draw ratio of 12.4 to obtain a precursor fiber having a single fiber fineness of 0.7 d. It was found that the precursor fiber had a strength of 0.77 GPa and an elongation of 11.8%, and the iodine adsorption was 1.2% by weight. The orientation degree determined by X-ray diffractometry was 91.4%.

The obtained precursor fiber was subjected to an oxidation treatment under tension in air heated at 240° C., at a stretch ratio of 1.08 for 5 minutes, and the fiber was further subjected to an oxidation treatment in heated air having a temperature gradient such that the temperature was gradually elevated from 250° C. to 270° C. at a constant length.

The water content in the obtained oxidized fiber was 5.8%, and the degree of orientation of the pre-graphite structure corresponding to the carbon network by X-ray diffractometry was 82.3%.

The so-obtained oxidized fiber was carbonized under a tension such that a shortening of the fiber length in a carbonizing furnace did not occur. The carbonizing furnace used was sealed with a nitrogen atmosphere, and had a temperature gradient such that the temperature was elevated from 400° C. to 1,300° C. The carbonized fiber was graphitized at a highest temperature of 2,450° C.

The strength characteristics of the obtained graphite fiber were determined by the impregnated strand method according to JIS R-7601. It was found that the strength was 4.1 GPa and the elastic modulus was 450 GPa. Thus, it was confirmed that a graphite fiber having a very high strength was obtained.

The specific gravity of the obtained fiber was 1.84, the orientation degree of the carbon network determined by the X-ray diffractometry was 91.0%, and the crystal size ($L_c$) was 44 Å. The microvoid radius calculated from the small-angle scattering was 16 Å.

Thus, it was confirmed that the so-obtained graphite fiber had a relatively small crystal size and a small microvoid radius and therefore the graphite fiber was structurally dense.

By using the so-obtained graphite fiber and an epoxy resin containing boron trifluoride monoethylamine (Epikote 828 supplied by Shell) as the matrix, test pieces of a composite material having a fiber content of about 60% were prepared according to customary procedures, and the obtained composite was evaluated.

It was found that the tensile strength was 2.2 GPa, the flexural strength was 1.4 GPa, and the compression strength was 1.2 GPa. Accordingly, it was confirmed that the compression strength of the composite material was very high, as compared with the compression strength of a composite of conventional graphitized fibers.

EXAMPLE 2

By using the same polymer as used in Example 1, precursor fibers were prepared according to the wet spinning method while changing the substantial draft of the spun fiber by changing the extrusion orifice diameter in the range of from 0.05 to 0.075 mm in 6,000 orifices as a whole, and the coagulation and take-up speeds.

Note, the substantial draft referred to herein means the ratio $V_i/V_f$ of the take-up speed $V_i$ under coagulation conditions to the free linear extrusion speed $V_f$.

Other conditions were the same as those adopted in Example 1. However, under some drafts, it was impossible to set the total draw ratio to 12.4. In this case, a highest draw ratio attainable was adopted.

The graphitizing temperature was controlled in each run so that the elastic modulus was about 450 GPa.

The main conditions and obtained results are shown in Table 1.

If the elastic modulus is 450 GPa, $L_c^3$ should be equal to or smaller than $114\times10^3$, that is, the crystal size ($L_c$) should be equal to or smaller than 48.5 Å. It is seen that, when the precursor fiber has a low denseness and a large amount of iodine absorption, the elastic modulus is difficult to increase and the graphitizing temperature should be elevated, resulting in the formation of a graphite fiber having a large $L_c$ value and a large microvoid size, and consequently, in a reduction of the compression strength of the composite.

TABLE 1

| Run No. | Spinneret orifice diameter (mm) | Substantial draft | Total draw ratio | Iodine adsorption amount of precursor fiber (%) | Orientation degree of oxidized fiber (%) | Graphitizing temperature (°C.) | $L_c$ (Å) | Microvoid size (Å) | Compression strength (GPa) |
|---|---|---|---|---|---|---|---|---|---|
| 1 | 0.05 | 2.1 | 12.4 | 1.3 | 82.3 | 2400 | 44 | 17.1 | 1.2 |
| 2 | 0.05 | 3.5 | 12.4 | 2.0 | 81.7 | 2450 | 46 | 17.5 | 1.1 |
| 3 | 0.065 | 2.5 | 12.4 | 1.8 | 80.8 | 2500 | 46 | 17.4 | 1.1 |
| 4 | 0.065 | 5.1 | 11.8 | 3.1 | 77.8 | 2900 | 55 | 25.4 | 0.71 |
| 5 | 0.075 | 3.8 | 12.4 | 2.2 | 79.7 | 2650 | 46 | 19.6 | 1.1 |
| 6 | 0.075 | 5.5 | 10.2 | 4.1 | 76.6 | 2900 | 54 | 22.4 | 0.76 |

EXAMPLE 3

By using the precursor fiber obtained at run No. 3 of Example 2, graphite fibers having a different elastic modulus, as shown in Table 2 and FIG. 1, were prepared by changing the water content in the oxidized fiber in the range of 4 to 9%, using a highest temperature at the graphitizing step in the range of 2,400° to 2,900° C., and at a draw ratio in the range of 0.95 to 1.12.

FIG. 1 shows the relationships between the crystal size $L_c$ (Å) and the elastic modulus E (GPa) in the graphite fibers obtained in Example 3. In FIG. 1, the solid line is the boundary line of the formula (I) defined in the present invention and each numeral suffix indicates the run number in Example 3.

TABLE 2

| Run No. | Tensile strength (GPa) | Elastic modulus (GPa) | $L_c$ (Å) | Microvoid size (Å) | Compression strength (GPa) |
|---|---|---|---|---|---|
| 1 | 3.9 | 440 | 42 | 16.2 | 1.2 |
| 2* | 3.5 | 450 | 51 | 17.6 | 0.98 |
| 3 | 3.7 | 490 | 47 | 16.8 | 1.1 |
| 4* | 3.2 | 490 | 58 | 20.5 | 0.85 |
| 5* | 2.8 | 540 | 62 | 21.4 | 0.71 |
| 6 | 3.4 | 590 | 54 | 18.3 | 0.98 |
| 7 | 3.2 | 620 | 58 | 18.9 | 0.90 |

*Comparative examples

EXAMPLE 4

The oxidized fiber obtained in Example 1 was carbonized under a tension such that a shortening of the fiber length in a carbonizing furnace sealed with a nitrogen atmosphere did not occur. The carbonizing furnace used had a temperature gradient such that the temperature was elevated from 400° C. to 1,300° C.

The carbonized fiber was graphitized at a highest temperature of 2,250° C.

When the strength characteristics of the obtained graphite fiber were determined by the impregnated strand method according to JIS R 7601, it was found that the strength was 4.4 GPa and the elastic modulus was 390 GPa, and it was confirmed that a graphite fiber having a very high strength was obtained.

The specific gravity of the obtained graphite fiber was 1.81, the orientation degree of the carbon network determined by the X-ray diffractometry was 87.5%, and the crystal size ($L_c$) was 36 Å. The microvoid size calculated from the small-angle scattering was 15 Å. Thus, it was confirmed that the so-obtained graphite fiber had a relatively small crystal size and a small microvoid size and the fiber was structurally dense.

In the same manner as described in Example 1, test pieces of a composite material were prepared by using the so-obtained graphite fiber and the composite was evaluated.

The tensile strength was 2.4 GPa, the flexural strength was 1.7 GPa, and the compression strength was 1.4 GPa, and it was confirmed that the composite material had a very high compression strength, even though it was prepared by using a graphite fiber having a high elastic modulus.

EXAMPLE 5

By using the same polymer as used in Example 1, precursors were prepared by the wet-spinning method by changing the substantial draft of the spun fiber by changing the spinneret orifice diameter in the range of from 0.05 to 0.075 mm in 6,000 orifices as a whole, and the coagulation and take-up speeds.

The substantial draft referred to herein means the ratio $V_i/V_f$ of the take-up speed ($V_i$) under coagulation conditions to the free extrusion linear speed ($V_f$). Other conditions were the same as those adopted in Example 1. Under some drafts, it was impossible to set the total draft ratio to 12.4. In this case, a highest draw ratio attainable was adopted.

In each run, the graphitizing temperature was set so that the elastic modulus was 390 GPa. The main conditions and obtained results are shown in Table 3.

If the elastic modulus is 390 GPa, $L_c^3$ should be equal to or smaller than $6\times10^4$, that is, the crystal size ($L_c$) should be equal to or smaller than 39.1 Å. It is seen that, if the denseness of the precursor fiber is low and the amount of iodine absorption is large, the elastic modulus is difficult to increase and the graphitizing temperature should be elevated, and the $L_c$ value is large and the microvoid size is large, with the result that the compression strength of the composite is low.

TABLE 3

| Run No. | Spinneret orifice diameter (mm) | Substantial draft | Total draw ratio | Iodine adsorption amount of precursor fiber (%) | Orientation degree of oxidized fiber (%) | Graphitizing temperature (°C.) | $L_c$ (Å) | Microvoid size (Å) | Compression strength (GPa) |
|---|---|---|---|---|---|---|---|---|---|
| 14 | 0.05 | 2.1 | 12.4 | 1.3 | 82.3 | 2250 | 36 | 16.4 | 1.4 |
| 15 | 0.05 | 3.5 | 12.4 | 2.0 | 81.7 | 2300 | 38 | 17.0 | 1.2 |
| 16 | 0.065 | 2.5 | 12.4 | 1.8 | 80.8 | 2350 | 38 | 16.9 | 1.2 |
| 17 | 0.065 | 5.1 | 11.8 | 3.1 | 77.8 | 2750 | 48 | 22.1 | 0.87 |
| 18 | 0.075 | 3.8 | 12.4 | 2.2 | 79.7 | 2500 | 39 | 19.1 | 1.2 |
| 19 | 0.075 | 5.5 | 10.2 | 4.1 | 76.6 | 2750 | 46 | 21.5 | 0.92 |

EXAMPLE 6

Figure 2:
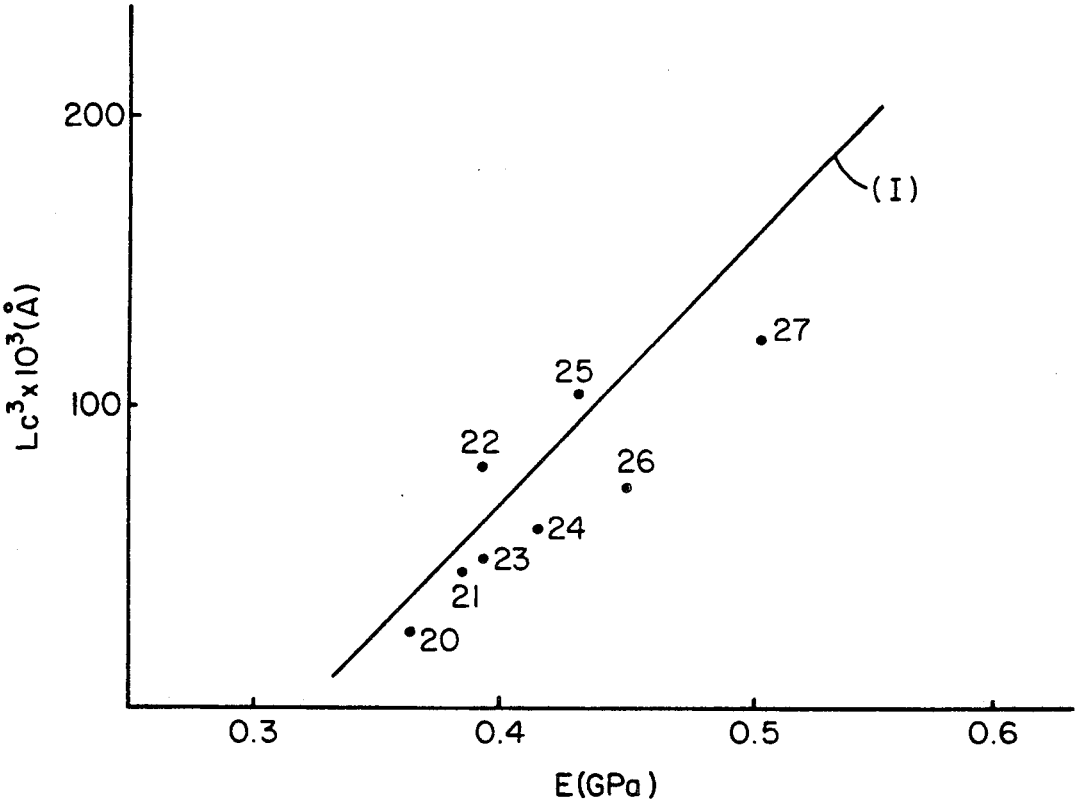
Figure 3:
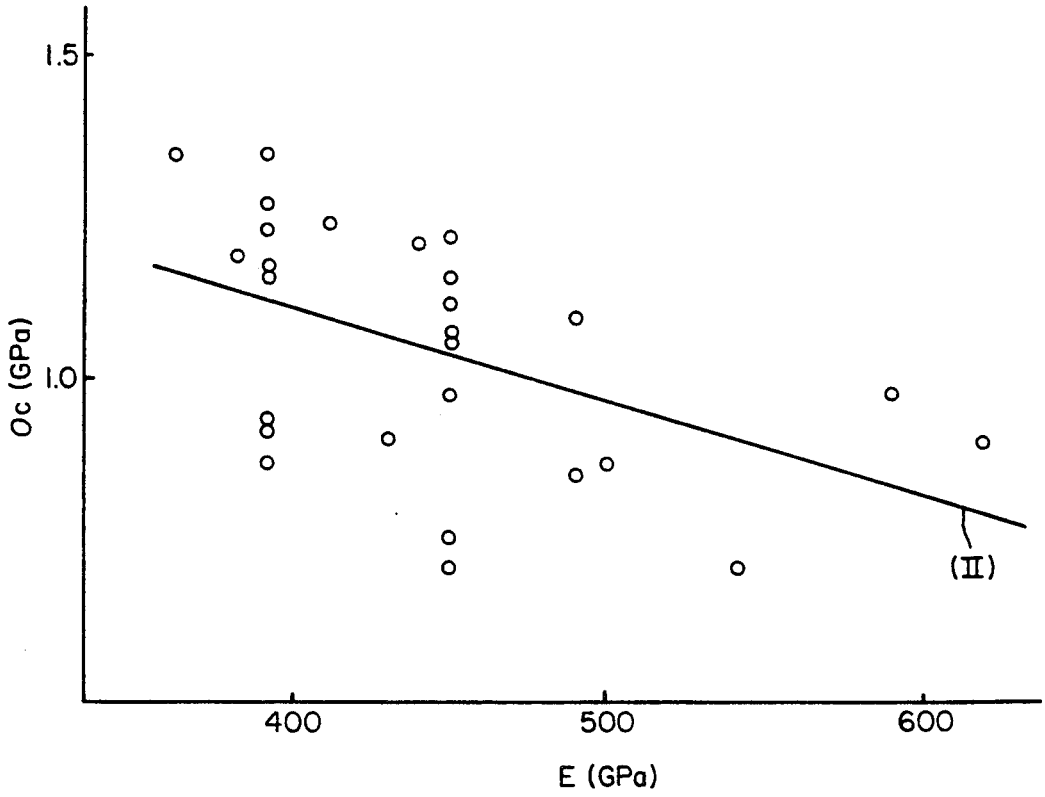
FIG. 3 illustrates the relationship between the composite compression strength $\sigma c$ (GPa) and the elastic modulus E (GPa) in all of the graphite fibers (inclusive of fibers outside the scope of the present invention)

Graphite fibers having a different elastic modulus, as shown in Table 4 and FIG. 2, were obtained by using the precursor fiber obtained at run No. 16 of Example 5 and changing the water content of the oxidized fiber in the range of 4 to 9%, using a highest graphitizing temperature in the range of 2,000° to 2,850° C., and at a draw ratio in the range of 0.95 to 1.12.

FIG. 2 shows the relationships between the crystal size $L_c$ (Å) and the elastic modulus (GPa) in the graphite fibers obtained in Example 6. In FIG. 2, the solid line is the boundary line of the formula (I) defined in the present invention, and each numeral suffix indicated the run number in Example 6.

TABLE 4

| Run No. | Tensile strength (GPa) | Elastic modulus (GPa) | $L_c$ (Å) | Microvoid size (Å) | Compression strength (GPa) |
|---|---|---|---|---|---|
| 20 | 4.1 | 360 | 30 | 15.3 | 1.4 |
| 21 | 4.0 | 380 | 36 | 18.0 | 1.2 |
| 22* | 3.6 | 390 | 43 | 19.1 | 0.94 |
| 23 | 3.7 | 390 | 37 | 17.8 | 1.3 |
| 24 | 4.3 | 410 | 39 | 19.0 | 1.2 |
| 25* | 3.6 | 430 | 47 | 23.2 | 0.91 |
| 26 | 3.5 | 450 | 42 | 19.2 | 1.2 |
| 27* | 3.7 | 500 | 50 | 25.0 | 0.87 |

*Comparative examples

We claim:

1. A process for making a graphite fiber, which comprises the steps of:

preparing a precursor fiber having an iodine adsorption amount of not larger than 3% by weight and an orientation degree of at least 85%, by spinning a dope of an acrylonitrile copolymer comprised of 92 to 99.95% by weight of acrylonitrile units and 0.05 to 8% by weight of copolymerized monomer units;

oxidizing the precursor fiber at a temperature of 200° to 300° C. in an oxidative atmosphere containing at least 15% by volume of oxygen while being kept under tension during at least a portion of the oxidation to obtain an oxidized fiber having a water adsorption of not larger than 7% by weight and an orientation degree of at least 78% carbonizing the oxidized fiber at a temperature of 400° to 1,500° C. in an inert atmosphere under tension to obtain a carbonized fiber; and then graphitizing the carbonized fiber to create a graphite fiber at a highest temperature of 2,200° to 2,800° C. in an inert atmosphere under tension.

2. A process according to claim 1, wherein the precursor fiber has a single fiber denier of from about 0.1 to 1.

3. A process according to claim 1, wherein the precursor fiber is prepared by a dry jet wet spinning method.

4. A process according to claim 1, wherein the precursor fiber is prepared at a substantial draft of from about 1 to 6 and a draw ratio of at least 10:1.

5. A process for making a graphite fiber for use in composite materials having high compression strength, said process comprising the steps of:

a. preparing a precursor fiber having an iodine adsorption not exceeding about 3% by weight and an orientation degree of at least about 85% by spinning a dope of acrylonitrile copolymer comprising from about 92 to about 99.95% by weight of acrylonitrile units and from about 0.05 to about 8% by weight of copolymerized monomer units;

b. oxidizing said precursor fiber to obtain an oxidized fiber having a water adsorption not exceeding about 7% by weight and an orientation degree of at least about 78% by i) heating said precursor fiber to a temperature in the range of from about 200° to 300° C., ii) exposing said precursor fiber to an oxidative atmosphere containing at least about 15% by volume of oxygen, and iii) placing said precursor fiber under tension during at least a portion of said oxidation;

c. carbonizing said oxidized fiber by i) heating said oxidized fiber to a temperature in the range of from about 400° to 1,500° C. in an inert atmosphere, and ii) placing said oxidized fiber under tension; and then d. graphitizing said carbonized fiber to create a graphite fiber by i) heating said carbonized fiber to a maximum temperature not exceeding about 2,200° to 2,800° C. in an inert atmosphere, and ii) placing said carbonized fiber under tension.

6. A process for making a graphite fiber according to claim 5 wherein said precursor fiber has a single fiber denier not exceeding approximately one.

7. A process for making a graphite fiber according to claim 5 wherein said spinning step is performed according to a dry jet wet spinning method.

8. A process for making a graphite fiber according to claim 5 wherein said precursor fiber is prepared at a draft not exceeding approximately six and a draw ratio of at least about 10:1.

9. A process for making a graphite fiber having an elastic modulus E of 340 to 680 GPa, wherein the crystal size $L_c$ (Å) as determined from the half value width of the diffraction to the (002) plane of the carbon network by wide-angle X-ray diffraction satisfies the formula (I) relative to the elastic modulus E (GPa) of the fiber:

$$L_c^3 \leqq 0.918 \times 10^3 E - 3 \times 10^5 \quad \text{(I)}$$

and the microvoid radius determined by small-angle X-ray scattering is not larger than 20 Å; and the compression strength $\sigma c$ (GPa) of a composite prepared by using the graphite fiber satisfies the requirement represented by the following formula (II) relative to the elastic modulus E (GPa) of the graphite fiber:

$$\sigma c \geqq 1.715 - 1.5 \times 10^{-3} E \quad \text{(II)},$$

which comprises the steps of:

preparing a precursor fiber formed in an organic solvent coagulation solution having an iodine adsorption amount of not larger than 3% by weight and an orientation degree of at least 85%, by spinning a dope of an acrylonitrile copolymer comprised of 92 to 99.95% by weight of acrylonitrile units and 0.05 to 8% by weight of copolymerized monomer units;

oxidizing the precursor fiber at a temperature of 200° to 300° C. in an oxidative atmosphere containing at least 15% by volume of oxygen while being kept under tension at least during a portion of the oxidation to obtain an oxidized fiber having a water adsorption of not larger than 7% by weight and an orientation degree of at least 78%;

carbonizing the oxidized fiber at a temperature of 400° to 1,500° C. in an inert atmosphere under tension to obtain a carbonized fiber; and then graphitizing the carbonized fiber to create a graphite fiber at a highest temperature of 2,200° to 2,800° C. in an inert atmosphere under tension.

10. A process for making a graphite fiber having an elastic modulus E of 340 to 680 GPa, wherein the crystal size $L_c$ (Å) as determined from the half value width of the diffraction to the (002) plane of the carbon network by wide-angle X-ray diffraction satisfies the formula (I) relative to the elastic modulus E (GPa) of the fiber:

$$L_c^3 \leqq 0.918 \times 10^3 E - 3 \times 10^5 \quad \text{(I)}$$

and the microvoid radius determined by small-angle X-ray scattering is not larger than 20 Å; and the compression strength $\sigma c$ (GPa) of a composite prepared by using the graphite fiber satisfies the requirement represented by the following formula (II) relative to the elastic modulus E (GPa) of the graphite fiber:

$$\sigma c \geqq 1.715 - 1.5 \times 10^{-3} E \quad \text{(II)},$$

which comprises the steps of:

preparing a copolymerized methacrylic acid/acrylonitrile copolymer precursor fiber having an iodine adsorption amount of not larger than 3% by weight and an orientation degree of at least 85%, by spinning a dope of an acrylonitrile copolymer comprised of 92 to 99.95% by weight of acrylonitrile units and 0.05 to 8% by weight of copolymerized monomer units;

oxidizing the precursor fiber at a temperature of 200° to 300° C. in an oxidative atmosphere containing at least 15% by volume of oxygen while being kept under tension at least during a portion of the oxidation to obtain an oxidized fiber having a water adsorption of not larger than 7% by weight and an orientation degree of at least 78%;

carbonizing the oxidized fiber at a temperature of 400° to 1,500° C. in an inert atmosphere under tension to obtain a carbonized fiber; and then graphitizing the carbonized fiber to create a graphite fiber at a highest temperature of 2,200° to 2,800° C. in an inert atmosphere under tension.

* * * * *